US008578831B2

(12) United States Patent
Adler et al.

(10) Patent No.: US 8,578,831 B2
(45) Date of Patent: Nov. 12, 2013

(54) SYSTEMS AND METHOD FOR IGNITING EXPLOSIVES

(75) Inventors: Richard J Adler, Marana, AZ (US); Joshua A. Gilbrech, Tucson, AZ (US); Darell W. New, Sahuarita, AZ (US); Daniel T. Geyer, Tucson, AZ (US)

(73) Assignee: Applied Energetics, Inc., Tucson, AZ (US)

( * ) Notice: Subject to any disclaimer, the term of this patent is extended or adjusted under 35 U.S.C. 154(b) by 55 days.

(21) Appl. No.: 13/195,793

(22) Filed: Aug. 1, 2011

(65) Prior Publication Data

US 2012/0073426 A1 Mar. 29, 2012

Related U.S. Application Data

(63) Continuation-in-part of application No. 11/126,509, filed on May 9, 2005, now Pat. No. 7,987,760.

(60) Provisional application No. 61/420,750, filed on Dec. 7, 2010, provisional application No. 60/678,240, filed on May 3, 2005.

(51) Int. Cl.
*F41H 11/136* (2011.01)

(52) U.S. Cl.
USPC ..... 89/1.13; 102/403; 102/427

(58) Field of Classification Search
USPC ..... 89/1.13; 102/402, 403, 427, 217; 86/50
See application file for complete search history.

(56) References Cited

U.S. PATENT DOCUMENTS

| | | | | |
|---|---|---|---|---|
| 1,999,414 | A * | 4/1935 | King | 361/219 |
| 4,012,641 | A * | 3/1977 | Brickerd et al. | 307/106 |
| 5,079,482 | A * | 1/1992 | Villecco et al. | 315/111.81 |
| 5,623,171 | A * | 4/1997 | Nakajima | 307/106 |

* cited by examiner

*Primary Examiner* — Stephen M Johnson
(74) *Attorney, Agent, or Firm* — Duft Bornsen & Fettig, LLP; Gregory T. Fettig

(57) ABSTRACT

Systems and methods are presented herein that provide for ignition of explosive devices through electric discharge. In one embodiment, an electrostatic discharge is directionally propagated through air to conduct electric current to the explosive device. The electric current may ignite the explosive device via heat, via triggering of ignition circuitry, via induced electric current conduction to the explosive material therein and/or via direct electric conduction to the explosive material therein. Alternatively or additionally, a system is configured with a vehicle to distally position the propagated energy to the explosive device such that damage caused by the explosive device is reduced.

28 Claims, 15 Drawing Sheets

SYSTEMS AND METHOD FOR IGNITING EXPLOSIVES

CROSS-REFERENCE TO RELATED APPLICATIONS

This patent application is a continuation-in-part patent application claiming priority to and thus the benefit of an earlier filing date from U.S. patent application Ser. No. 11/126,509 (filed May 9, 2005), now U.S. Pat. No. 7,987,760, which claims priority to and thus the benefit of an earlier filing date from U.S. Provisional Patent Application No. 60/678,240 (filed May 3, 2005), the entire contents of each of which are hereby incorporated by reference. This continuation-in-part patent application also claims priority to and thus the benefit of an earlier filing date from U.S. Provisional Patent Application No. 61/420,750 (filed Dec. 7, 2010), the entire contents of which are hereby incorporated by reference.

FIELD OF THE INVENTION

The invention generally relates to the ignition of explosive devices from a defensive perspective (e.g., to safely pre-detonate land mines, improvised explosive devices (IEDs), roadside bombs, etc.).

BACKGROUND

Attacks by opposing forces exist in a variety of forms, including military enemies, terrorists, and/or militant groups. Such attacks often include more covert aggression in the form of entrapment devices, or booby-traps, such as landmines and IEDs. These entrapment devices are exceptionally hazardous and often result in the lost lives of peacekeeping forces and damage to vehicles and other equipment. Generally, the groups using such devices are unorganized and rely on unconventional methods of attack. For example, terrorists may bury roadside bombs without direction or coordination from an organized chain of command. Thus, when these devices are not used, they are often forgotten about and remain as a hazard to non-combatants after aggressions/hostilities cease.

Certain devices, such as landmines are pressure sensitive devices that ignite based on the depression of a triggering mechanism. These devices may be ignited simply by means of dragging weighted objects across the ground where the device lies. For example, during the Vietnam War, helicopters would drag large/heavy metal platforms across the ground to trigger landmines. While this method may still be useful in igniting pressure sensitive devices, it is substantially ineffective at igniting electronically triggered explosive devices, such as IEDs, because these devices are not typically designed to ignite upon physical force. For example, an IED may be placed underground or roadside by terrorists and connected to some sort of triggering mechanism that remotely detonates the explosive thereof when desired (e.g., a switch in communication with a cellular telephone, wires connected to a remote switch, etc.). Thus, the triggering mechanism may be used by the terrorists to ignite the IED when the terrorist's target passes by. Ignition of the IED is intended to confuse, disable and/or destroy the terrorist's target. IED's at the very least cause apprehension and lost focus amongst peacekeeping forces and civilians. Ignition or disabling of an IED prior to its intended ignition by terrorists (e.g., pre-detonation) may substantially reduce their overall effectiveness.

SUMMARY

The invention generally relates to systems and methods for igniting or disabling explosive devices, such as landmines, IEDs, and roadside bombs, particularly from a defensive posture that substantially reduces or reduces their overall effectiveness. In one embodiment of the invention, an electric field is pulsed in relatively short durations to cause electric current flow to/through the explosive device. The electric current is used to thereby ignite explosive material therein and/or disable the detonating electronics while personnel and/or equipment are at a safe "standoff" distance.

Generally, a wire, blasting cap, and/or other IED component changes the electric field around the IED when a voltage is applied. This electrical anomaly may create electric arcs that initiate from the IED and subsequently conduct to the electrical source (e.g., an electrode) providing the electric field. In this regard, the electric arcs may be considered as "attracted" to the IED. And, when an electric arc strikes the IED, it is likely to carry electric current through the IED's blasting cap. That electric current, under proper conditions, sets off the blasting cap and pre-detonates the IED, thereby protecting personnel and equipment defensively postured behind the electrical source.

In some instances, the efficiency of electrical arcs can be negatively impacted by the conductivity of the soil. Electric fields from an electrode at or above the surface of the soil decrease with depth when the soil is conductive. These problems may be overcome through the use of relatively short electrical pulses. For example, disturbed soil characterization is a major concern since IEDs are typically buried for immediate use. That is, the soil is disturbed because it is "dug up" within hours of the expected detonation. The electric field reduction can be generally characterized by the parameter $\rho\epsilon$, where $\rho$ is the resistivity of disturbed soil and $\epsilon$ is the dielectric constant of the disturbed soil. Thus, by properly characterizing these parameters of the disturbed soil, the voltage and/or duration of the pulses may be adjusted accordingly and penetrate the soil to achieve electric arcs with a buried IED.

This pulse counter-IED technique also provides the ability to use electrodes that are in contact with the ground. In general, electrodes such as chains, wheels, etc., in contact with the ground discharge or undergo severe high power loading due to the conductivity of the soil. And, pre-detonation with long pulses generally requires high powers. Short pulses with relatively high peak power means that electrodes in contact with the ground undergo the same peak power drain as longer pulses or continuous excitation from an electrode. However, the average power drain of short pulses is quite modest.

Devices for generating short pulses may be implemented as a matter of design choice. For example, spark gap systems and generators, such as Tesla coils and high voltage generators, developed by North Star Research Corp, may be used to generate short pulses. Magnetic compression generators may shorten pulses via the sequential switching of saturable reactors. A magnetic compression generator is a device that generates a high-power electromagnetic pulse by compressing magnetic flux via an explosive. These devices employ magnetic flux compression that is made possible when time scales over which the device operates are sufficiently brief and resistive current loss is negligible. For example, the magnetic flux on any surface surrounded by a conductor (e.g., a copper wire) remains constant, even though the size and shape of the surface may change. Generally, any change in the system provokes an opposing change. Thus, reducing the area of the surface enclosed by the conductor, which would reduce the magnetic flux, results in the induction of current in the electrical conductor, thereby returning the enclosed flux to its original value. A magnetic compression generator implements this phenomenon with powerful explosives, the energy of which partially transforms into the energy of an intense magnetic field surrounded by a correspondingly large electric current. A saturable reactor is a special form of inductor where the magnetic core can be deliberately saturated by means of a direct electric current flowing in a control winding. Once saturated, the inductance of the saturable reactor drops dramatically. Based on the forgoing, it should be understood that the invention is not intended be limited to any particular form of short pulse generation.

The electrical energy of the pulses may be transmitted (e.g., capacitively, inductively, and/or through direct discharges) to the explosive device or wires connected thereto from a distally positioned electrode to ignite the device. For example, electrical energy may be directly discharged from an electrode to the explosive device. The electrical energy may directly ignite the explosive device through heating and/or indirectly triggering of the device by means of electrical propagation through the device's circuitry. We suspended away, the electrode may provide a safer standoff distance. Additionally, the electrode may be configured from expendable components such that it may be sacrificed if the explosive is ignited.

In another embodiment, a relatively strong electric field is generated in the vicinity of the explosive device in order to induce electric current to heat the device. For example, the strong electric field may be such that an induced electric current flows within components of the explosive device (e.g., wires, metal housing, and/or the explosive material itself). Additionally, a strong electric field passing in the vicinity of the explosive device may cause electric current to arc about metallic edges of the housing and/or cause current to flow within wires of the device. This electric current may subsequently flow through the trigger, bridge wire, and/or the explosive material of the device to ignite the explosive material thereof.

Additionally or alternatively, the strong electric field may create an electrical breakdown in the gas (e.g., air) between the source of the electric field and the explosive device. This breakdown causes electric current to conduct directly into the device and/or wires connected thereto. This electric current may thereby ignite the explosive material of the device and/or disable the triggering electronics. The electric field may be strong enough to provide an arc of electric current to the device, even if the device is underground. For example, the electric current conducted to ground (e.g., earth ground) dissipates within the ground just as lightning dissipates within the ground during a strike. However, a strong enough electric field may create a dielectric breakdown of the air that arcs to ground and penetrates the surface of the ground to some depth, such as lightning does. This ground penetrating electric current may flow to the explosive device and ignite the explosive material therein.

The above-mentioned embodiments may be deployed in a variety of ways. For example, a high-voltage generator may be mounted to a vehicle (e.g., a "wheeled" vehicle, a helicopter, etc.) that travels ahead of a formation (e.g., a single person, a battalion, a group of vehicles, etc.). Alternatively or additionally, the vehicle may have one or more arms or "booms" that extend and/or dangle from the vehicle. These booms may include electrodes that are electrically coupled to the high-voltage generator to provide a strong electric and/or magnetic field in the vicinity of an explosive device and thereby ignite the device as described hereinabove. Other embodiments may include "rollers" that arc to an explosive device. For example, a vehicle may be configured with a mine roller having conductive wheels and/or an electrode that is electrically coupled to a high-voltage generator so as to create an electric field that causes arcing to or within the explosive device. In this regard, the mine roller may be pushed in front of the vehicle so as to provide a defensive position during pre-detonation of the explosive device. Other exemplary embodiments are described below.

BRIEF DESCRIPTION OF THE DRAWINGS

Some embodiments of the present invention are now described by way of example only and with reference to the accompanying drawings. The same reference number represents the same element or the same type of element on all drawings.

DETAILED DESCRIPTION OF THE DRAWINGS

Figure 1:
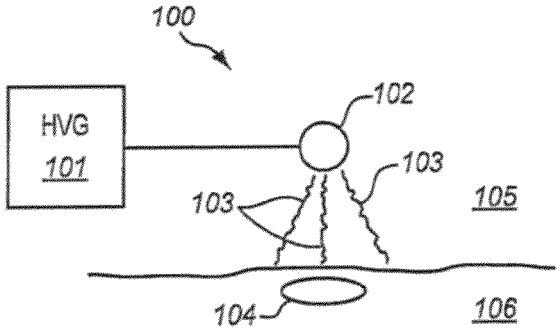
FIG. 1 illustrates a system for igniting an explosive device by conducting (e.g., arcing or discharging) electric current to the device, in one exemplary embodiment of the invention.

While the invention is susceptible to various modifications and alternative forms, specific embodiments thereof have been shown by way of example in the drawings and are herein described in detail. It should be understood, however, that the invention is not intended to be limited to the particular forms disclosed. Rather, the invention is to cover all modifications, equivalents, and alternatives falling within the scope and spirit of the invention as defined by the claims.

FIG. 1 illustrates a system 100 for igniting an explosive device 104 by conducting (e.g., "arcing") electric current 103 to the device, in one exemplary embodiment. The explosive device 104 may be buried in the ground 106. For example, an opposing force (e.g., a terrorist, a militant group, and/or a military enemy) may bury an explosive device to covertly create confusion with, damage, and/or destroy a peacekeeping force. Examples of such include the use of IEDs in Afghanistan and postwar Iraq against the United States peacekeeping forces.

The system 100 includes a high-voltage generator 101 (i.e., labeled HVG 101) configured for generating a substantially high-voltage. For example, the HVG 101 may be a voltage generator capable of generating voltages of 50 kilovolts or higher. The HVG 101 is electrically coupled to an electrode 102, which subsequently provides electric current in the form of electric current arcs 103 through the region 105 (e.g., a gas such as air) and/or through the ground 106 to the explosive device 104. The electric current provided by the electrode 102 may cause electric current to flow within explosive device 101. For example, the electric current may flow through wires, housing components, and/or the explosive material itself of the explosive device 104. This current flow may directly ignite the explosive device 104 without causing damage to units therebehind (e.g., people, vehicles, other equipment, etc.). Alternatively, the electric current may be used to disable the explosive device 104 by either physically damaging circuitry of the explosive device 104 and/or by disabling processing features of the explosive device 104 (e.g., by scrambling or deleting computer memory).

In one embodiment, the HVG 101 includes a Tesla coil configured for delivering the electrical energy. In such an embodiment, the Tesla coil may be configured with elements that provide means for discharging electrical energy from the Tesla coil. For example, a Tesla coil can obtain very high voltages capable of generating electrical discharge via air breakdown over relatively large distances. Conduction paths leading away from a Tesla coil can be enhanced through elements configured on the electrode 102, such as ridges or other features that tend to direct the electrical energy in some manner. With a large enough charge delivered to the Tesla coil, the ability of that charge to break down insulative characteristics of the region 105 is increased to create a conduction path to the explosive device 104.

Figure 2:
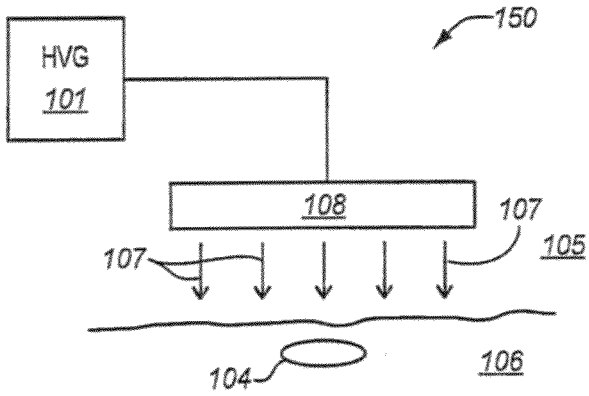
FIG. 2 illustrates another system for igniting an explosive device by generating a strong electric field in the vicinity of the device, in one exemplary embodiment of the invention.

FIG. 2 illustrates another system 150 for igniting an explosive device 104 by generating a strong electric field 107 in the vicinity of the explosive device, in one exemplary embodiment. The system 150 also includes the HVG 101 to generate a substantially high-voltage as described hereinabove. The system 150 also includes an electrode 108 which holds an electric charge from the HVG 101. For example, the electrode 108 may function as a capacitor plate which creates a strong electric field 107 in the presence of a dielectric, such as the region 105.

The electric field 107 may be strong enough to penetrate the ground 106 and introduce electric current flow in the explosive device 104. For example, the presence of the electric field 107 in the vicinity of the explosive device 104 may create arcs of electric current between conductible components of the explosive device 104 and/or create electric current flow through the explosive material of the device itself, directly and/or inductively. The electric current may be sufficient to ignite the explosive material of the explosive device 104. Moreover, the heat generated by the electric field may be sufficient to ignite the explosive device 104. In one embodiment, the electric field 107 is an alternating or time-varying electric field used to provide sustained heating of the explosive device 104. For example, the electric current provided to electrode 108 may be alternating electric current ("AC") that is used to generate a corresponding alternating electric field with the electrode 108. The HVG 101 in this regard may be a high voltage AC generator.

Figure 3:
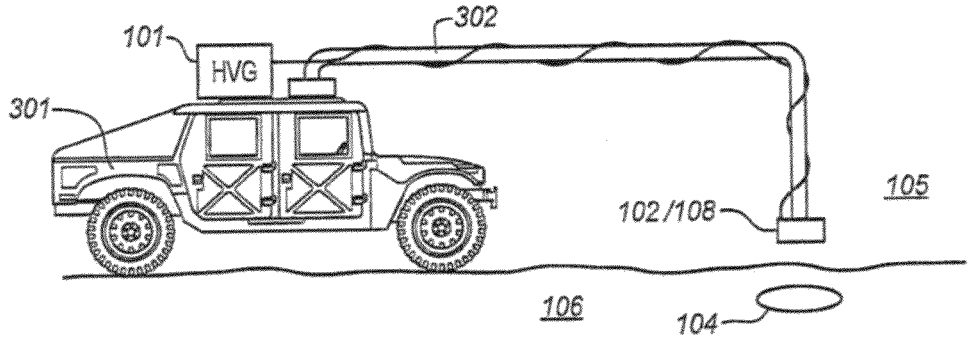
FIG. 3 illustrates a ground vehicle operable with an explosive device ignition system, in one exemplary embodiment of the invention.

FIG. 3 illustrates a ground vehicle 301 operable with an explosive device ignition system, such as systems 100 and 150 shown and described above, in one exemplary embodiment. In this embodiment, the ground vehicle 301 includes a boom 302 which operates as an arm to support the electrode 102/108. The electrode 102/108 is electrically coupled to the HVG 101 to deliver electric current to the explosive device 104 and thereby ignite the device as described above. The HVG 101 may be carried on the ground vehicle 301 or by another vehicle. The ground vehicle 301 may be man-piloted or piloted via remote control.

The boom 302 is configured to deliver electric current to the explosive device 104 in a manner that distances the ignition of the device 104 from the ground vehicle 301. Accordingly, damage is typically only sustained to the electrode 102/108. In one embodiment, the electrodes 102/108 are configured from inexpensive materials and are connectable in such a way as to allow for rapid replacement. While one embodiment has been shown and described, those skilled in the art should readily recognize that the invention is not intended to be limited to the illustrated embodiment. For example, the ground vehicle 301 may be configured in other ways which allow for the HVG 101 to deliver electric current to the electrode 102/108 from a distance to substantially prevent damage to the ground vehicle 301 upon ignition of the explosive device 104. Additionally, the invention should not be limited to the single boom 302 and/or the electrodes 102/108. Other embodiments may include a plurality of electrodes 102/108 attached to one or more booms 302. For example, a plurality of electrodes 102/108 may be configured in a rake configuration which allows for electrostatic discharge to the explosive device 104 from one or more discharge points.

Figure 4:
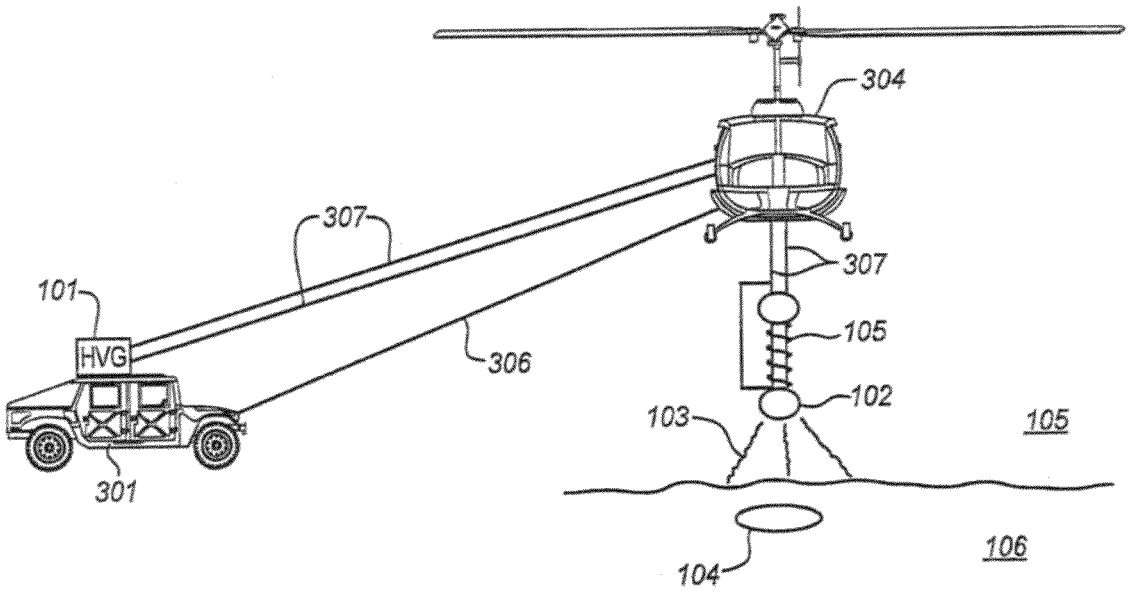
FIG. 4 illustrates an air vehicle operable with an explosive device ignition system, in one exemplary embodiment of the invention.

FIG. 4 illustrates an air vehicle 304 (e.g., a helicopter, drone, hovercraft, etc.) operable with an explosive device ignition system in one exemplary embodiment. For example, the air vehicle 304 may be configured to "dangle" the electrode 102 to conduct (e.g., arc) the electric current 103 to the explosive device 104 within the ground 106 and thereby ignite the explosive device 104. The electrode 102 may be dangled at a distance from the air vehicle 304 which would substantially reduce danger from ignition of the explosive device 104. As with the ground vehicle 301, the air vehicle 304 may be man-piloted or piloted via remote control.

In this embodiment, the electrode 102 may include a Tesla coil that is coupled to the HVG 101. Within this coupling, voltage from the HVG 101 maybe "stepped up" to a higher voltage than that generated by the HVG 101 alone. The Tesla coil 305 has a primary side coupled to the HVG 101 which induces electric current within a secondary side 305. The secondary side of Tesla coil 305 in this embodiment may be coupled to the electrode 102 such that the electric current induced by the primary side of the Tesla coil 305 may be discharged to the explosive device 104 as described above. The air vehicle 304 may include a cable 306 that is used as a tether between the air vehicle and the nearby ground vehicle 301. For example, the HVG 101 may be configured with the ground vehicle 301 such that high-voltage generation is not performed upon the air vehicle 304; rather, it is generated upon the ground vehicle 301 and transferred to the electrode 102 via high-voltage cables 307. Such a configuration may reduce the overall weight of an aircraft. Alternatively, the tethered connection between the ground vehicle 301 and the air vehicle 304 may include power and control for the air vehicle as well as the electrical energy from the HVG 101. The ground vehicle 301 may also be remote piloted. As mentioned, the HVG 101 may be configured in a variety ways. In one embodiment, the HVG 101 may be implemented as a Marx generator that charges multiple capacitors in series and then configures them together in parallel to achieve higher voltages.

Electrical breakdown of air may depend on, among other things, particulates in the air and/or distance between the electrode 102 and the explosive device 104. Once the electric potential reaches a level high enough to overcome the insulative features of the air, electrical discharge may conduct to the explosive device 104. In some instances, the electrical discharge may be strong enough to penetrate the ground 106 under which the explosive device is buried. For example, electrical conduction in the explosive device 104 may be the result of inductive influences upon the device as electrical energy discharges to the ground.

Figure 5:
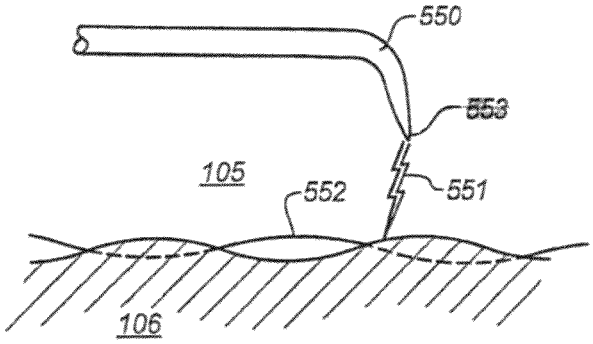
FIG. 5 illustrates an electrode for providing electrical discharge to an explosive device or a wire thereof, in one exemplary embodiment of the invention.

Electrical breakdown of the air may also depend on the shape of the electrode. FIG. 5 illustrates an electrode 550 having a shape for providing electrical discharge to a wire 552 of the explosive device 104, in one exemplary embodiment of the invention. For example, the electrode 550 may be configured with a tip 553 that causes the preferential discharge 551 to the wire 552 as the electrode 550 comes within proximity of the wire 552. However, the invention is not intended to be limited to any particular shape as other electrode shapes may also be implemented to concentrate the electric field to a point that enhances discharge 551, current flow within the wire 552, and/or arcing within other metallic components of the explosive device 104. One example of a shape that may enhance the electric field is shown and described in spherical electrode embodiments below.

Figure 6:
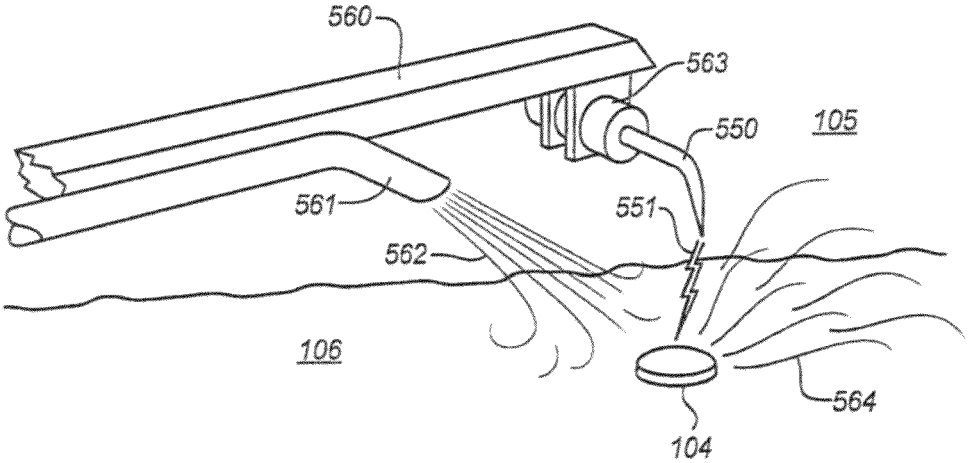
FIG. 6 illustrates an electrode with a blower for providing electrical discharge to an explosive device, in one exemplary embodiment of the invention.

To further assist in this electrical breakdown of the air, the pre-detonation system may be configured with a blower that disturbs the ground covering the explosive device. For example, by blowing recently dug up dirt, a preferential path of conduction may be created with conductive particles of the dirt in the air and/or via the less grounded path between the electrode and the explosive device. FIG. 6 illustrates such with an electrode 550 and a blower 561, in one exemplary embodiment.

In this embodiment, the electrode 550 is configured with a boom 560 that extends the electrode 550 to a distance that offers relative safety from an explosion when the electrode 550 discharges to the explosive device 104. The blower 561 blows air 562 to at least partially unearth the explosive device 104. In this regard, the air 562 blown across the ground 106 may have a sufficient pressure to cause the ground 106 to "stir" and disperse from a buried explosive device, such as a land mine, an IED, etc. Accordingly, the explosive device 104 may be revealed and conduction of electrical discharge 551 to the explosive device may be improved.

As mentioned, particulates 564 caused by the disruption of the ground 106 may also improve conduction of electrical discharge 551. For example, the ground 106 may include materials that are conductive. Furthermore, particulates in the air may enhance local electric field effects that reduce breakdown thresholds. Accordingly, the particulates 564 may cause a conductive path between the electrode 550 and the explosive device 104. The conduction of the electrical discharge 551 may thereby directly ignite the explosive device 104.

Figure 7:
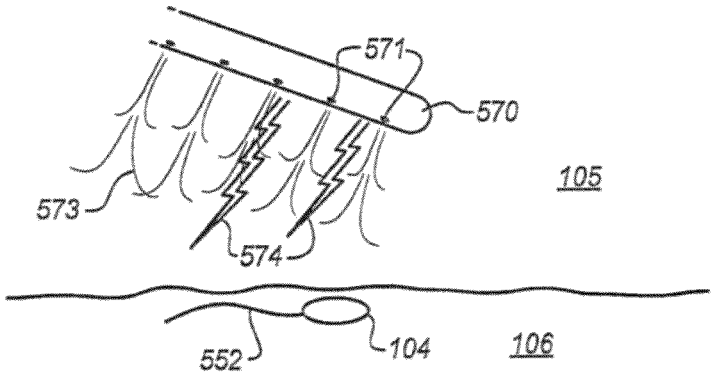
FIG. 7 illustrates an electrode/blower combination for providing electrical discharge to an explosive device, in one exemplary embodiment of the invention.

FIG. 7 illustrates an electrode/blower 570 for providing an electrical discharge 574 to the explosive device 104, in one exemplary embodiment. In this embodiment, the electrode/blower 570 configures the blower functionality with the electrode functionality. For example, the electrode/blower 570 may be a vented structure with holes 570 through which gas (e.g., air) 573 is forced. Additionally, the electrode/blower 570 may be configured from material that is conducive for maintaining electrical energy (e.g., copper, aluminum, or other conductive materials) such that the electrode/blower 570 may electrically discharge to the explosive device 104 or a wire 552 connected thereto.

The gas may also include particulates or aerosols to enhance the electrical discharge, for example, by reducing the voltage required for breakdown through effects such as local electrical field enhancement near the particulates. Particulates that are relatively easy to ionize may be selected to provide electrons to enhance discharge development. For example, an electric field within a particle may be reduced by charge movement or charge polarization. Charge displacement may enhance an electric field outside the particle. Local electric field enhancement around charged particles may enhance ionization and cascading electrical discharges at lower macroscopic electric field strengths.

The gas may be something other than air and selected to enhance the discharge. For example a gas with a relatively low ionization potential or having less electronegative components may allow for discharges over longer distances and/or for longer times while typically requiring less energy. One example of a gas already having particulates is the exhaust gas from an internal combustion engine, such as that commonly found in various vehicles. Moreover, electric discharge may be enhanced by heating the blown gas such that the gas and air obtains a lower density.

Figure 8:
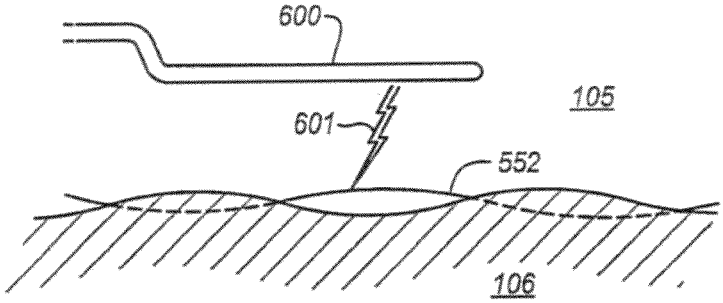
FIG. 8 illustrates another electrode for providing electrical discharge to an explosive device, in one exemplary embodiment of the invention.
Figure 9:
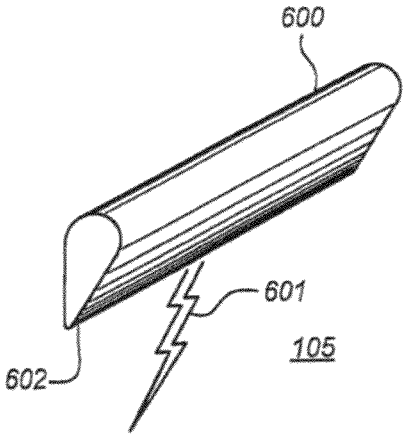
FIG. 9 illustrates a perspective view of the electrode of FIG. 8.

FIG. 8 illustrates an electrode 600 configured for providing electrical discharge 601 to an explosive device via the wire 552 connected thereto, in one exemplary embodiment of the invention. The electrode 600 may be configured as a plate having an edge 602 that advantageously directs electrical discharge 601 through the region 105 towards the explosive device 104. A perspective view of such is illustrated in FIG. 9. The electrode 600 may discharge electrical energy to objects that protrude from the ground 106. Since the electric field strength is not focused to a particular point, electrical energy may preferentially discharge from the electrode 600 to an object at the shortest distance between the object and the electrode. This type of discharge may allow for the electrode 600 to "find" the object and discharge thereto. Other embodiments below may improve the ability of the electrode to find the explosive device, such as with the spherical shaped electrode embodiments shown and described below.

Figure 10:
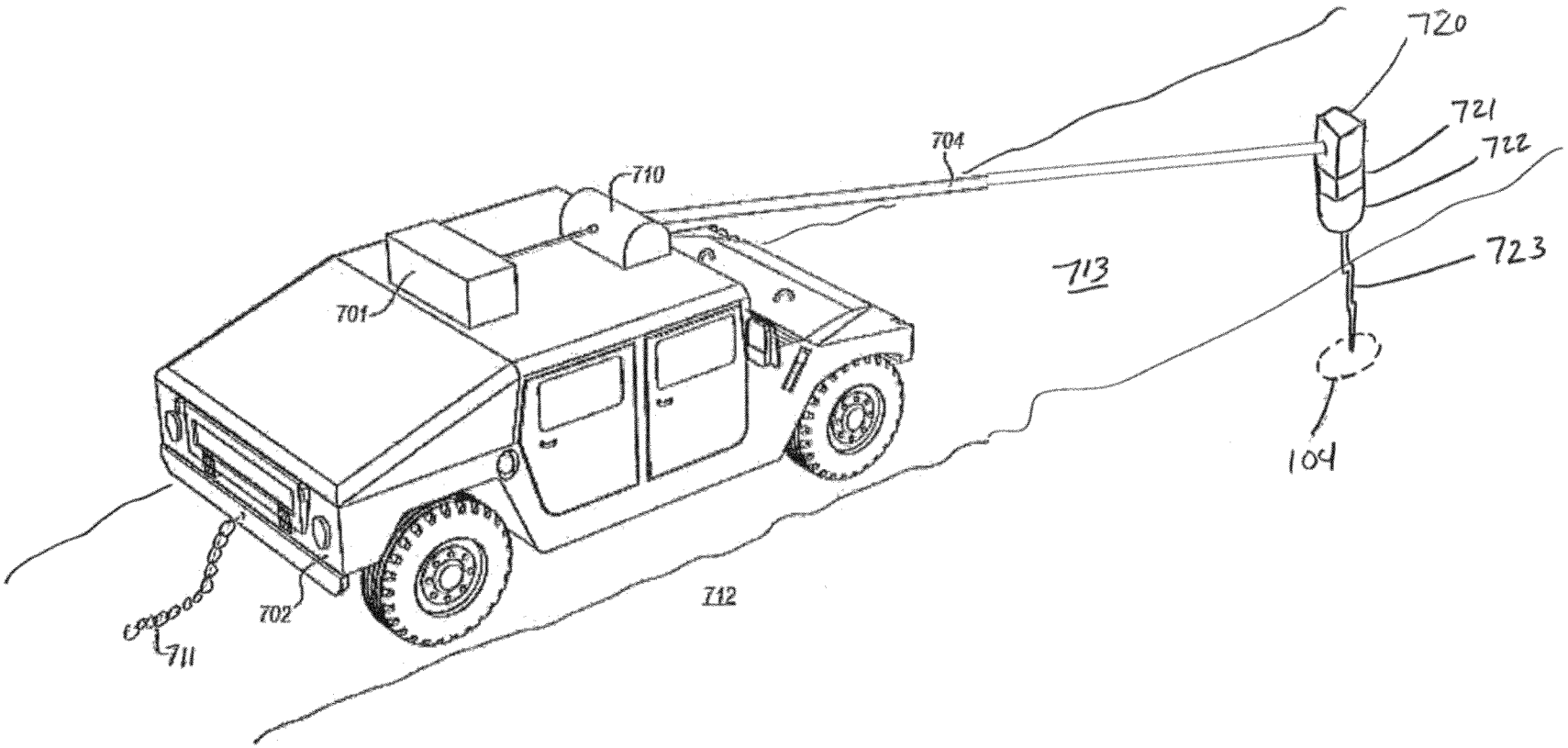
FIG. 10 illustrates a vehicle carrying an electrode for providing an electrical discharge to an explosive device, in one exemplary embodiment of the invention.

FIG. 10 illustrates a vehicle 702 carrying an electrode 722 for providing an electrical discharge 723 to an explosive device 104, in one exemplary embodiment, to pre-detonate the explosive device 104. For example, the vehicle 702 may be operable to distally propel the electrode 722 so as to provide the electrical discharge 723 to the explosive device 104 and detonate the explosive device 104 from a standoff position prior to its intended detonation from counter forces (e.g., terrorists, insurgents, militants, etc.). To further assist in this defensive posture, the vehicle 702 may be armored plated so as to protect personnel within the vehicle 702 and/or components of the vehicle itself.

The vehicle 702 is configured with an HVG 701 that is operable to generate relatively high voltage electrical energy. For example, the HVG 701 may be a diesel or gas powered generator capable of being mounted upon the vehicle 702 to generate at least 10 kV. To do so, the vehicle 702 may be configured with a grounding chain 711 (or a conductive cable) is operable to drag from the vehicle 702 to provide a ground reference potential for the HVG 701. The HVG 701 provides the high voltage electrical energy to a Tesla coil 720 or other loosely coupled transformer to increase the voltage of the electrical energy to a level sufficient for igniting the explosive device 104. For example, the Tesla coil 720 may substantially increase the voltage of the electrical energy from the generator 701 so as to create a relatively strong electric field about the electrode 722. When the electrode 722 comes into proximity of the explosive device 104, the electrode 722 may discharge (723) to the explosive device 104 to trigger and/or ignite the explosive material of the explosive device 104. In some instances, the potential between the explosive device 104 may be strong enough to penetrate the ground 712 under which the explosive device 104 may be buried, such as the case with an IED.

To provide the standoff position for the vehicle 702, the vehicle 702 may be configured with an arm 704 or other means for extending the Tesla coil 720 from the vehicle 702. In this regard, the vehicle 702 may be also configured with a mount 710 that is operable to position the arm 704 over the explosive device 104 as the vehicle 702 propagates along the road 713. The mount 710 may include some sort of actuator that is operable to move the arm 704. For example, the mount 710 may controllably position the arm 704 to avoid obstacles and the like such that the electrode 722 suspends above the explosive device 104.

Also configured with the electrode 722, in this embodiment, is a spark gap 721. The spark gap 721 generally comprises two conducting electrodes separated by a gap that is usually filled with a gas (e.g., air, sulfur hexafluoride, etc.). The gap is designed to allow an electric spark to pass between the conductors. That is, the gas therebetween breaks down when the voltage difference between the conductors exceeds the gap's breakdown voltage. Thus, a spark forms and ionizes the gas to drastically reduce its electrical resistance. Electric current then flows until the path of the ionized gas is broken and/or the current reduces below a minimum value called a "holding current". As the spark gap 721 provides some resistance until the gas in the gap is ionized, the spark gap 721 may allow the overall system to build up the voltage prior to the discharge from the electrode 722. For example, the output of the Tesla coil 720 may be configured with a capacitor that stores charge. A simple air breakdown could occur in some variable or uncontrollable manner once the charge reaches a particular voltage. The spark gap 721 may provide some controllable amount of resistance that prevents the capacitor from discharging until the potential on that capacitor is great enough break down the gas between the electrodes of the spark gap 721. Thereafter, the capacitor may discharge through the spark gap 721 to the electrode 722 such that it may discharge to the explosive device 104.

As the conditions between the electrode 722 and the explosive device 104 may vary depending on a particular operation (e.g., the mission of the vehicle 702, impurities in the air between the electrode 722 and the explosive device 104, temperature of the air, etc.), the spark gap 721 may be dynamically configured so as to model the electric field between the electrode 722 and the explosive device 104. For example, based on certain known environmental conditions of the vehicle's operation, the configuration of the spark gap 721 may be changed so as to mimic those environmental conditions. Such may include changing the distance between the electrodes in the spark gap 721 in a manner that simulates the environmental conditions. In this regard, the spark gap 721 may provide a means for preferentially attracting the discharge 723 between the electrode 722 and the explosive device 104.

As illustrated in this embodiment, the electrode 722 is generally round so as to provide a relatively equal distribution of the electric field about the electrode 722. In this regard, the electrode 722 may also provide a means for preferentially attracting the discharge 723 between the electrode 722 and the explosive device 104. For example, a conductive component of the explosive device 104, such as a tripwire or electronics, may change the orientation of the electric field as the electrode 722 comes into proximity of the explosive device 104. Thus, the generally equal distribution of the electric field about the round electrode 722 may intensify about a portion of the electrode 722 that is closest to the conductive component of the explosive device 104 such that the electrode 722 preferentially discharges (723) to that component.

Figure 11:
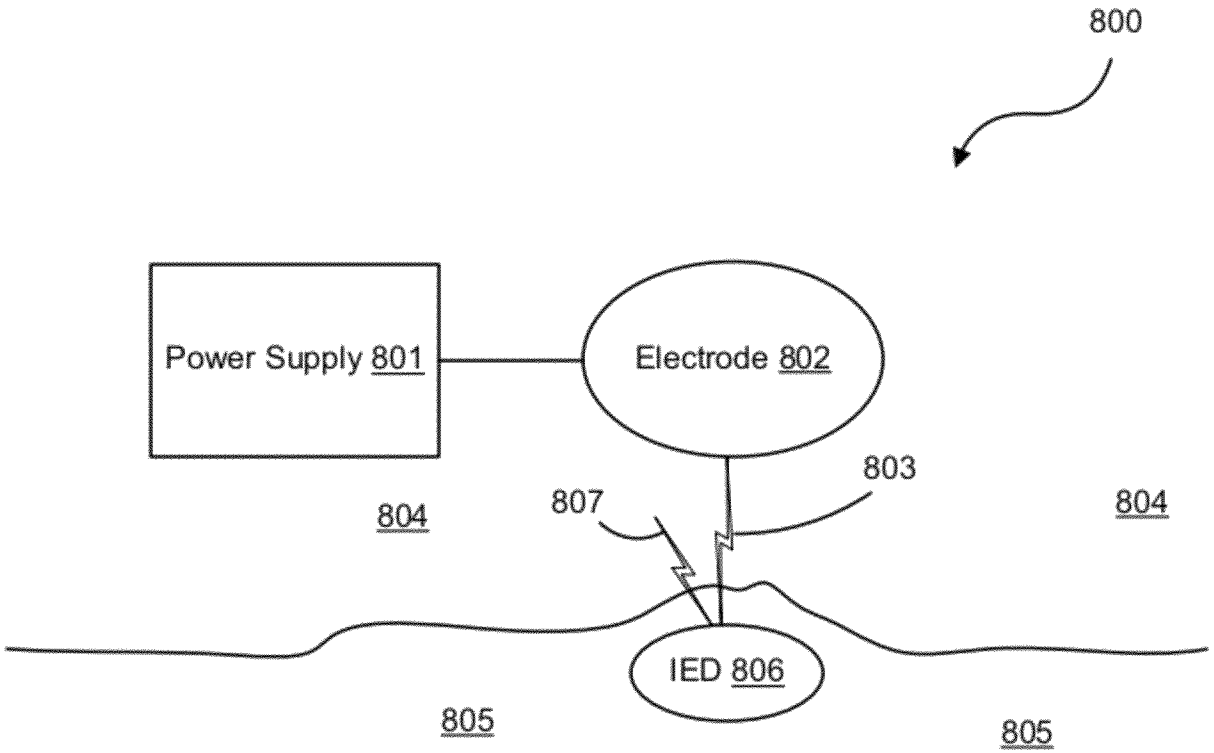
FIG. 11 illustrates an exemplary system for pre-detonating an IED, landmine, or other explosive device, in one exemplary embodiment of the invention.

FIG. 11 illustrates an exemplary system 800 for pre-detonating an IED 806, landmine, or other explosive device, in one exemplary embodiment of the invention. In this embodiment, the power supply 801 is operable to pulse the electrical energy to the electrode 802 so as to form an electric field about the electrode 802. In this regard, electrode 802 may be at least partially configured with a spherical shape. For example, the portion of the electrode 802 coming into the closest proximity with the IED 806 may be constructed of a generally spherical metallic body or "skin" such that it provides a generally equal distribution of an electric field when coupled to the power supply 801. Accordingly, when the system 800 comes into proximity with the IED 806 (i.e., the electrode 802 hovers over the IED 806), the electric field about the electrode 802 may discharge electrical energy (803) to the IED 806 through the air 804 and/or cause conductive components of the IED 806 to arc (807) through the air 804 to the electrode 802. In some embodiments, the voltage on the electrode 802 and other electrodes herein can reach levels of hundreds of kilovolts or even mega volts.

As the IED 806 is typically buried in a shallow layer of ground 805, a stronger electric field may be used to penetrate the ground 805 to cause the arcing/electrical discharge to the IED 806. Thus, the power supply 801 may be configured to provide relatively high voltage electrical energy to the electrode 802 (e.g., greater than about 10 kV). This voltage, however, may be "stepped up" so as to enhance the possibility for arcing/electrical discharge to the IED 806. In this regard, the system 800 may be configured with a loosely coupled transformer or Tesla coil as described above such that the electric field about the electrode 802 creates the arcing/electrical discharge when in the proximity of the IED 806.

As mentioned, the generally smooth shape of the electrode 802 allows the system 802 "find" the IED 806. For example, the electric field about the electrode 802 is generally evenly distributed. When the electrode 802 approaches a conductive material, such as the IED 806, the electric field is enhanced on conductive elements of the IED 806. Once the electric field exceeds the breakdown threshold at the IED 806, an electrical discharge is initiated from the IED 806 to the electrode 802. This electrical discharge either connects to the electrode 802 or to a discharge propagating from the electrode 802. Electric current flows through the discharge 803 and/or the arc 807 to pre-detonate the IED 806. Discharges that are initiated from the IED 806, effectively "find" the IED 806 through this process.

Figure 12:
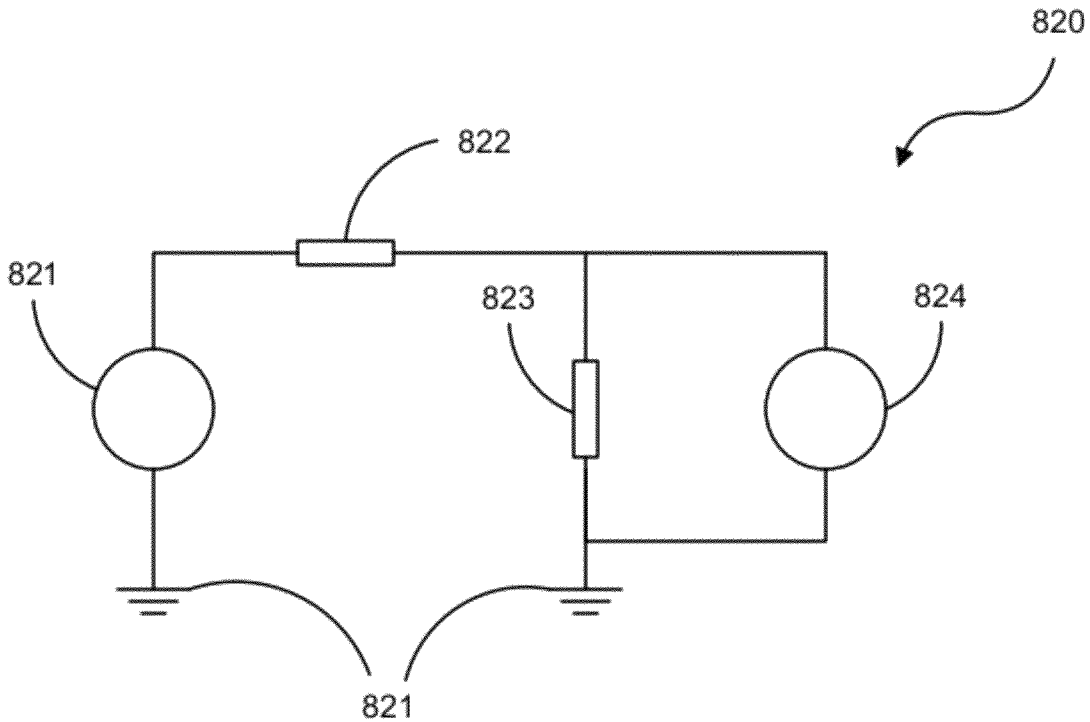
FIG. 12 is a circuit diagram representing a pulse discharge to ground from an electrode to pre-detonate an IED, landmine, or other explosive device, in one exemplary embodiment of the invention.

To assist in the pre-detonation of the IED 806, the power supply 801 may be configured to pulse the electrical energy to the electrode 802. The use of a relatively short pulse generally reduces the effect of the ground 805. For example, a long pulse excitation mode, the relatively low resistance of the ground 805 reduces the voltage applied so rapidly that it is difficult to apply a voltage in excess of 50 kV to the ground 805. A circuit diagram 820 of this process is illustrated in FIG. 12.

In general, for a relatively high voltage source 821, the resistance 822 is the source impedance. The resistance 823 is quite low to the ground reference potential 821 of the ground 805, so it is generally difficult to apply a high voltage to the ground 805. If the high-voltage source 821 is a capacitor with a switch, the resistance 822 is minimal and the voltage 824 may be applied by the electrode 802 for a time $t=c \cdot R$, where c is the capacitance of the high-voltage source 821 and R is the resistance 822, as illustrated with the pulse 843 in FIG. 13. In other words, a shorter pulse means the resistance 822 is less.

Figure 13:
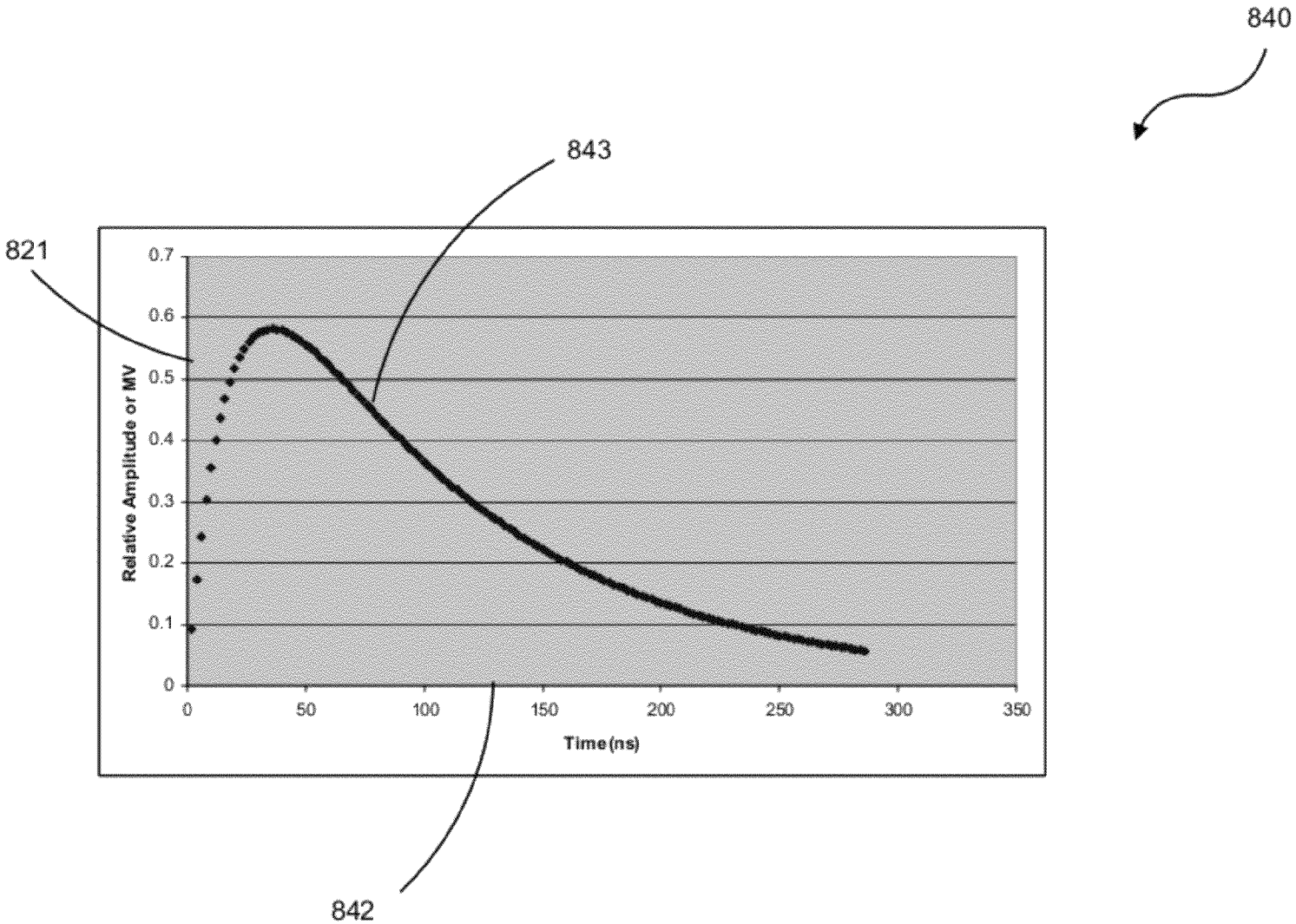
FIG. 13 is a graph of a "short" electrical pulse used to pre-detonate an IED, landmine, or other explosive device, in one exemplary embodiment of the invention.

Also, as short pulses provide a relaxation time for the power supply 801 to recover, higher voltages may be obtained for the short pulses. For example, continuous excitation and/or long pulse generation tends to drain the electrical energy from the power supply 801 when coupled to a loosely coupled transformer for discharge via the electrode 802. Accordingly, the shorter pulses, such as the pulse 843, provide a time for the power supply 801 to recover such that greater voltages may be achieved. In FIG. 13, the power supply 801 is illustrated as being operable to generate the exemplary pulse 843 of electrical energy with a peak magnitude of almost 600 kV with a duration of about 300 ns.

Additionally, if the electrode 802 is in contact with the ground 805 (e.g., via chains, conductive wheels, etc.), the ground 805 is discharged and/or undergoes severe high power loading due to the conductivity of the ground 805. The relatively short pulse of FIG. 13 at high peak power with the electrode 802 in contact with the ground 805 undergoes the same peak power drain as with longer pulses or continuous excitation. However, the average power drain is modest for shorter pulses and allows for more discharges 803 and/or arcs 807 to pre-detonate the IED 806. An example of such is illustrated in FIG. 14.

Figure 14:
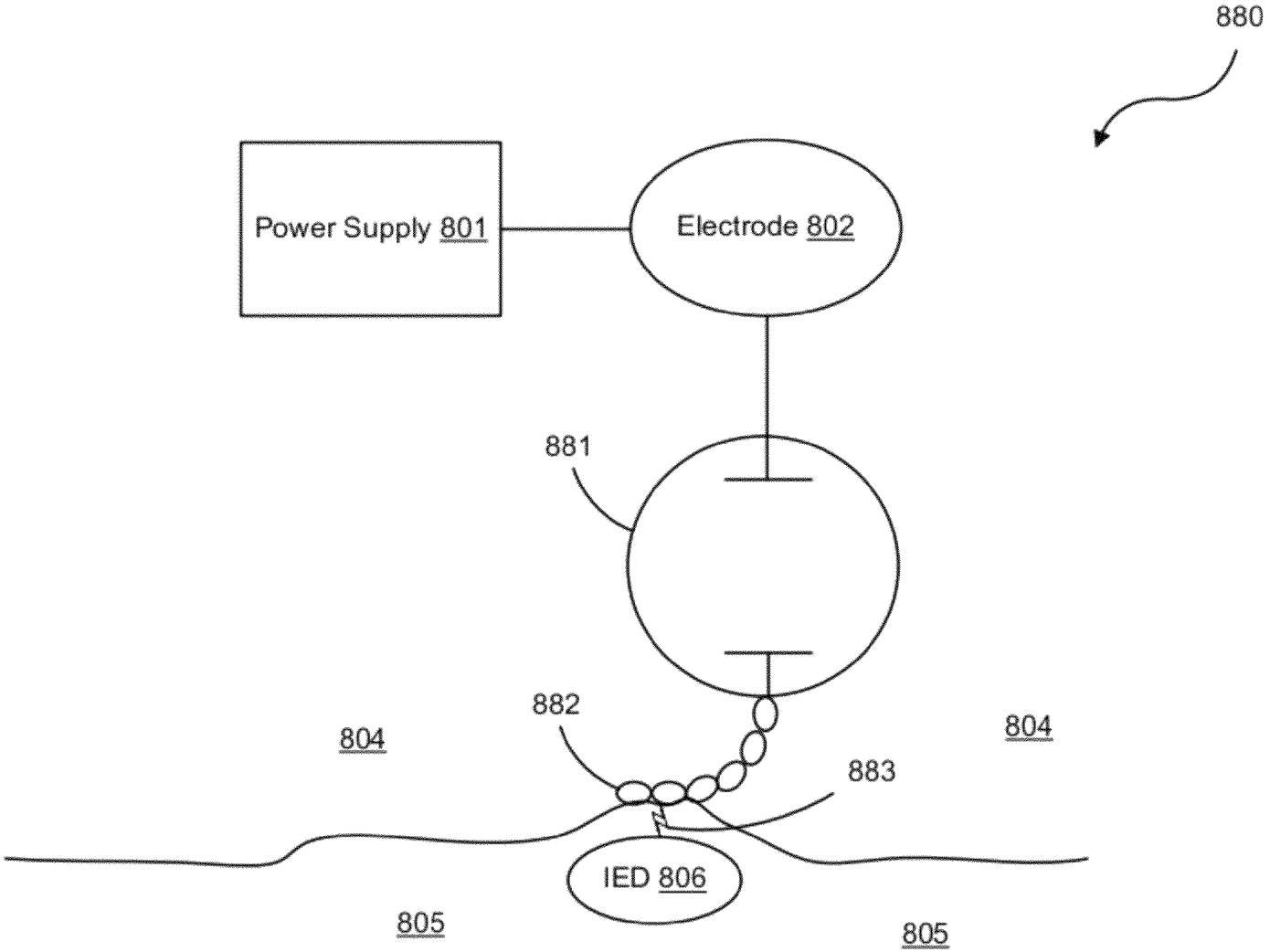
FIG. 14 illustrates another exemplary system for pre-detonating an IED, landmine, or other explosive device, in one exemplary embodiment of the invention.

FIG. 14 illustrates another exemplary system 880 for pre-detonating an IED 806, landmine, or other explosive device, in one exemplary embodiment of the invention. In this embodiment, the power supply 801 is again coupled to the electrode 802 to form an electric field about the electrode 802. Differing from other embodiments, however, is the introduction of the spark gap 881 with a chain 882 in contact with the ground 805. This essentially allows the system 880 to transition from a relatively high state of impedance to a relatively low state of impedance when exposed to a large voltage beyond the dV/dt capability of certain materials in the power supply 801 (e.g., materials of a transformer core within the power supply 801). In other words, the spark gap 881 essentially allows the power supply 801 to build up a stronger electric field on the electrode 802. Once the voltage of the electrode 802 overcomes the impedance of the spark gap 881, the electrode 802 discharges through the spark gap 881 to the chain 882.

The length of the chain 882 can vary. However, experimental results have revealed that certain lengths may be more optimal based on the conditions. For example, chains of most lengths are generally effective for discharging directly to the color components of the IED 806. However, shorter length chains are more effective for discharging to explosives that are buried deeper under the soil than longer chains. Some experimental results have shown that six-foot length chains are effective for pre-detonating explosives that come into direct contact with the chains. Other experimental results of shown that six-inch length chains are more effective for explosives that are buried under 1 inch or more of the soil.

Additionally, the spark gap 881 and chain 882 provide a means for lowering the impedance between the electrode 802 and the IED 806. For example, the distance between the chain 882 and the IED 806 may be relatively small and the chain 882 may even contact the IED 806 as it is dragged across the ground 805. Accordingly, the impedance between the chain 882 and the IED 806 may be relatively small. Thus, by coupling the high impedance of the spark gap 881 to the low impedance of the chain 882, the typically high impedance between the electrode 802 and the IED 806 may be placed more closely to the electrode 802 for a more controllable discharge to the IED 806. That is, the electrode 802 is more likely to conduct directly to the IED 806 through the spark gap 881 and the chain 882 than the electrode 802 would over a relatively high impedance of an over the air discharge between the electrode 802 and the IED 806.

Figure 15:
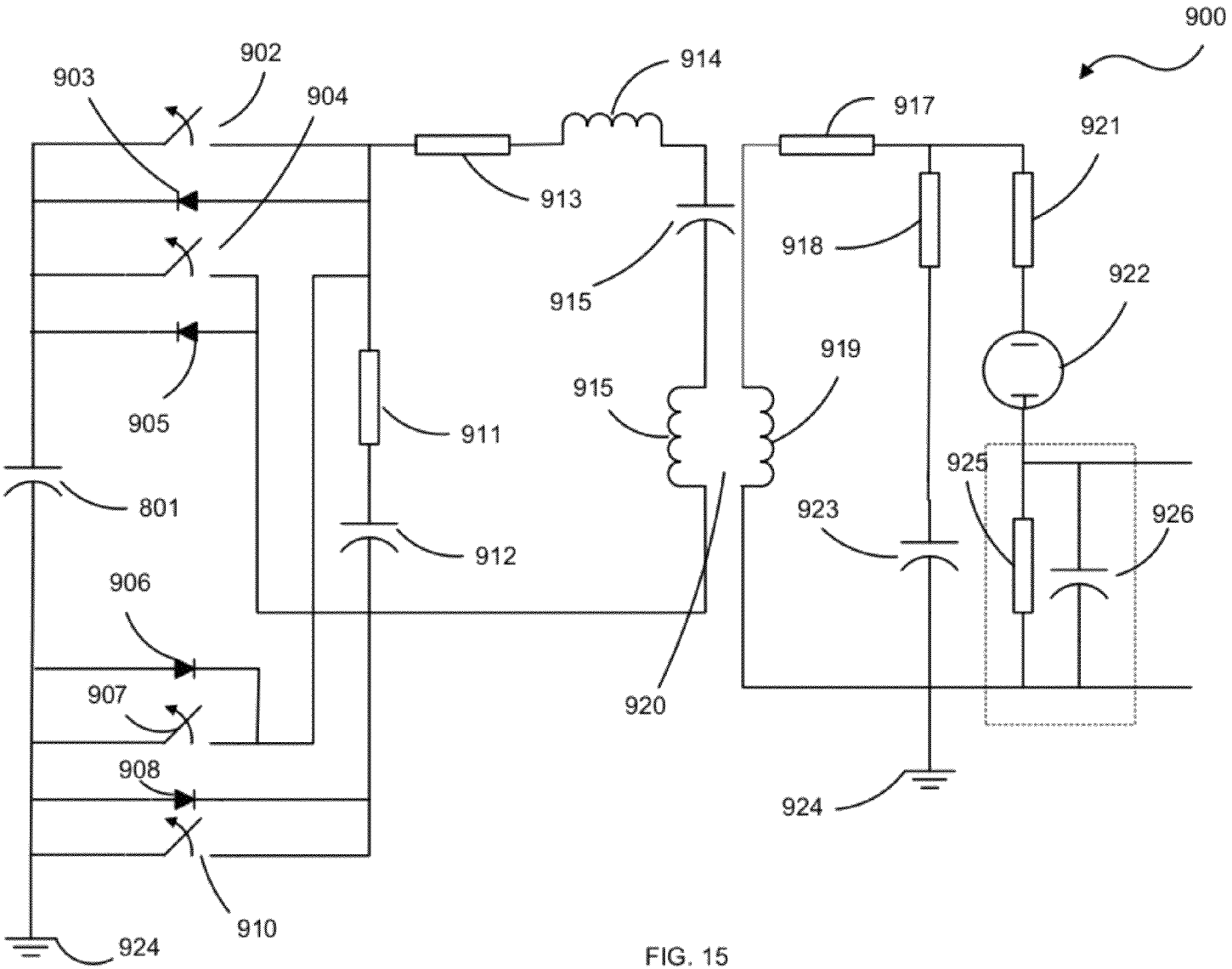
FIG. 15 is a circuit diagram of a system for pre-detonating an IED, landmine, or other explosive device, in one exemplary embodiment of the invention.

FIG. 15 is a circuit diagram 900 of a system for pre-detonating an IED, landmine, or other explosive device, in one exemplary embodiment of the invention. The system is designed to operate up to 300 kV with no corona or partial discharge present during operation at higher repetition rates. In one embodiment, a magnetic wire was utilized on the secondary 919 of the transformer 920. This allowed the system to achieve 330 kV but generally proved unable to operate at higher repetition rates without generation of corona and thus the subsequent wire to wire breakdown of the transformer 920. Accordingly, the system was modified by replacing the magnetic wire of the secondary 919 with a PVC insulated stranded wire. This embodiment allowed the system to operate up to 300 kV at 300 Hz without partial discharge or corona. Thus, in embodiments where 300V/turn or less for the transformer 920 are employed (e.g., an air core transformer), the magnet wire may be used. In this embodiment, the approximate inductance value of the primary 915 is 5.5 uH and approximate inductance value of the secondary 919 is 47 mH. The internal capacitance is approximately 300 pf.

Figure 16:
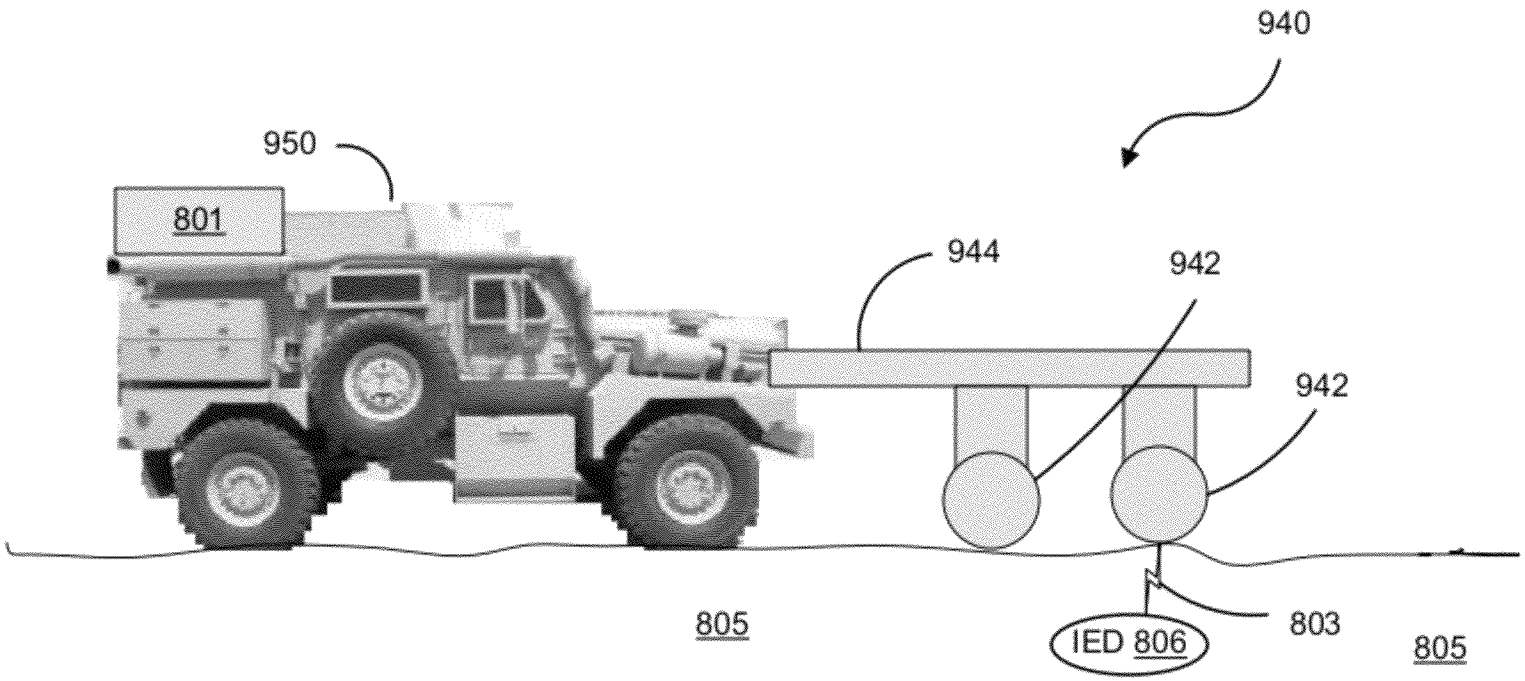
FIG. 16 illustrates a vehicle employing a system for pre-detonating an IED, landmine, or other explosive device, in one exemplary embodiment of the invention.

FIG. 16 illustrates a vehicle 950 employing a system 940 for pre-detonating an IED 806, landmine, or other explosive device, in one exemplary embodiment of the invention. In this embodiment, the vehicle 950 (e.g., a heavily armored vehicle operable to sustain operations after being exposed to an explosion) is configured with a generator 801 to provide electrical energy to the system 940. The generator 801, in this regard, may be a diesel or gas powered generator capable of running off the fuel system of the vehicle 950. The generator 801 is generally a high voltage generator capable of generating 10 kV or greater.

The system 940 is configured as a type of mine roller that extends (via an extender 944) in front of the vehicle 950 so that any explosion resulting from the system 940 may limit damage to the vehicle 950. That is, further distance between the vehicle 950 and any explosion may limit damage to the vehicle 950 itself. In this embodiment, the extender 944 extends one or more sets of wheels 942 in front of the vehicle 950. Thus, as the vehicle 950 moves along a road in an active/hostile environment (e.g., due to militant/terrorist activity), one of the wheels 942 may come within proximity of the IED 806.

To pre-detonate the IED 806, when one or more of the wheels 942 may be configured as the electrode 802 above. In this regard, the generator 801 may be electrically coupled to one or more of the wheels 942 such that electrical energy therefrom may be discharged to the IED 806. For example, the wheels of mine rollers are generally configured from large amounts of metal so as to crush underlying landmines. Accordingly, the large mine roller wheels may function as the electrode 802 so as to conduct electrical energy from the generator to the IED 806. In this regard, the wheel 942 may come into contact with the IED 806 and directly discharge to the IED 806 as the IED 806 is likely to be buried in a shallow portion of freshly disturbed soil. Alternatively or additionally, the wheel 942 may discharge through a relatively thin layer of soil the ground 805 to the IED 806 and/or crush/damage the electronic triggering mechanisms of the IED 806.

Figure 17:
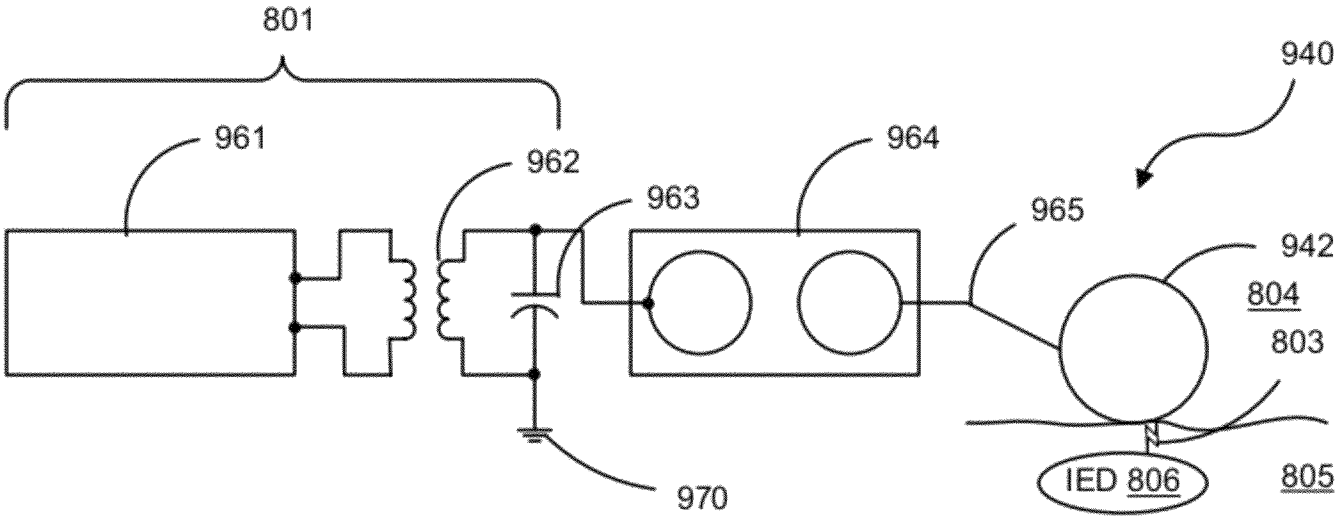
FIGS. 17-20 illustrate exemplary system-level implementations for pre-detonating an IED, landmine, or other explosive device.
Figure 18:
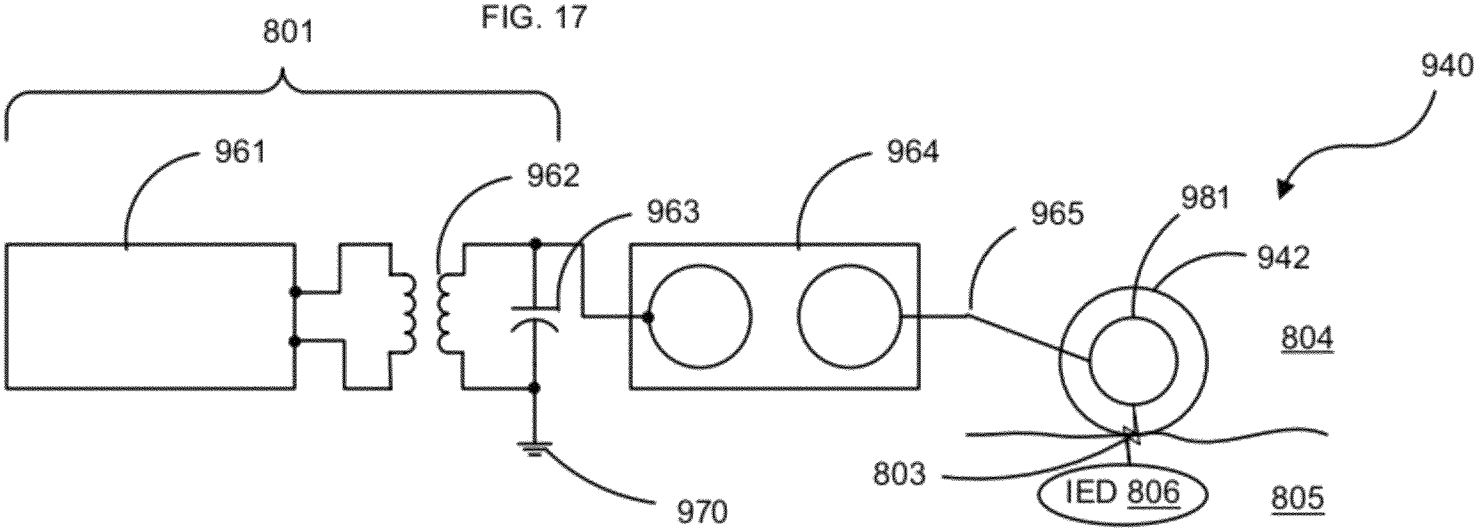
Figure 19:
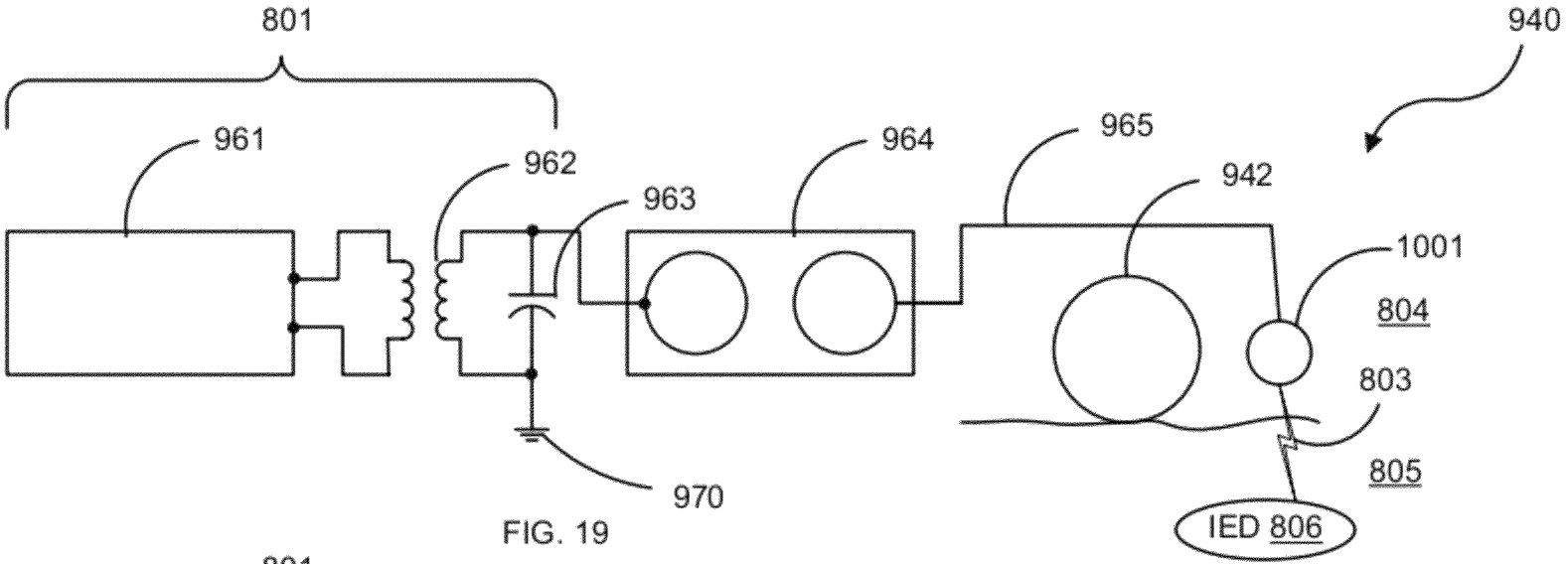
Figure 20:
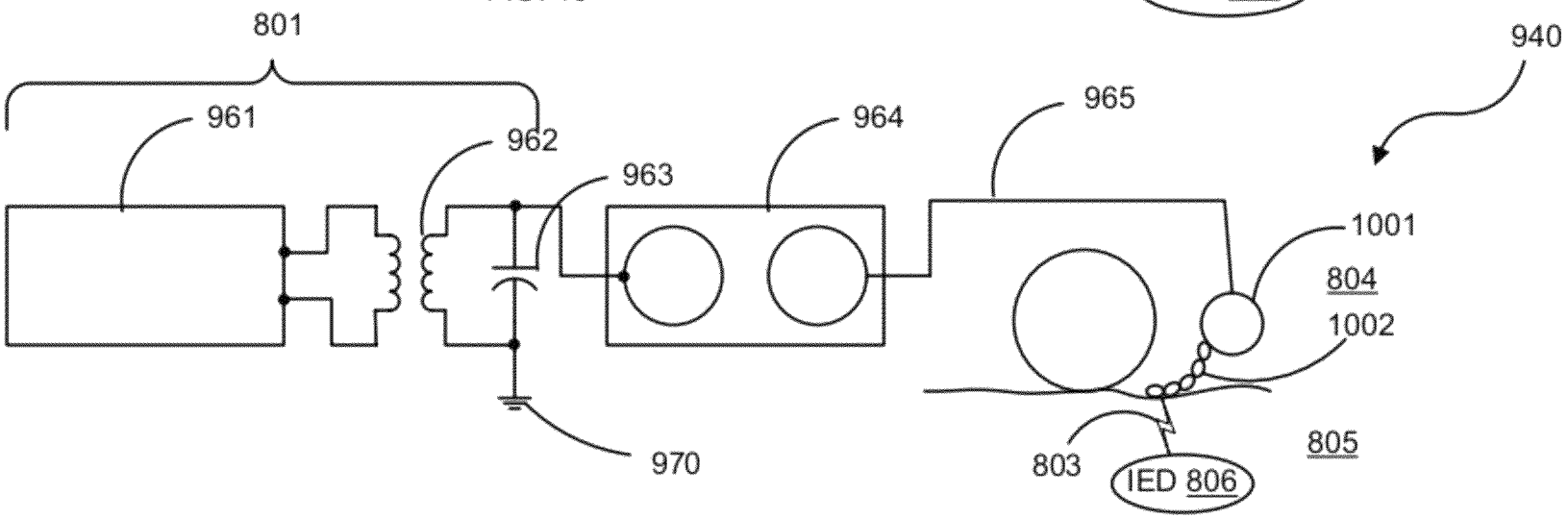

FIGS. 17-20 illustrate exemplary system-level implementations of the mine roller system 940 for pre-detonating an IED, landmine, or other explosive device. For example, the mine roller system 940 may be configured from the generator 801 that comprises a power supply 961 and the transformer 962 which mimics the circuit diagram 820 of FIG. 12. In this regard, the power supply 801 is operable to generate relatively high voltage energy and increase that voltage through the transformer 962. The capacitor 963 stores the electric charge until it overcomes the impedance presented by the spark gap 964, as described above. Thereafter, the electric charge discharges through the spark gap 964 over the conductor 965. Each of the FIGS. 17-20 illustrates a particular manner in which the electrical energy may be discharged to the IED 806. In FIG. 17, the conductor 965 is electrically coupled to the wheel 942 such that when the wheel 942 comes within proximity of the IED 806, the electrical energy discharges through the ground 805 to the IED 806. Alternatively or additionally, the wheel 942 may provide a strong enough electric field that causes arcing within the IED 806 that triggers pre-detonation of the IED. In FIG. 18, the conductor 965 is electrically coupled to a conductive rim 981 of the wheel 942. For example, the wheel may include a tire of some sort with a metal wheel or rim that is conductive. Accordingly, when the wheel 942 rolls over the IED 806, the discharge 803 may occur between the rim 981 and the IED 806 to pre-detonate the IED 806. In FIG. 19, the mine roller system 940 is configured to extend an electrode 1001 past the wheel 942 such that the electrode 1001 may discharge (803) to the IED 806 and/or form electrical arcs within the IED 806 so as to pre-detonate the IED 806. In FIG. 20, the electrode 1001 is configured with a chain 1002 that is operable to drag along the ground 805 as the mine roller system 940 rolls along the ground 805. As mentioned above, the chain 1002 brings the electric field into closer contact with the IED 806 for pre-detonating the IED 806.

Figure 22:
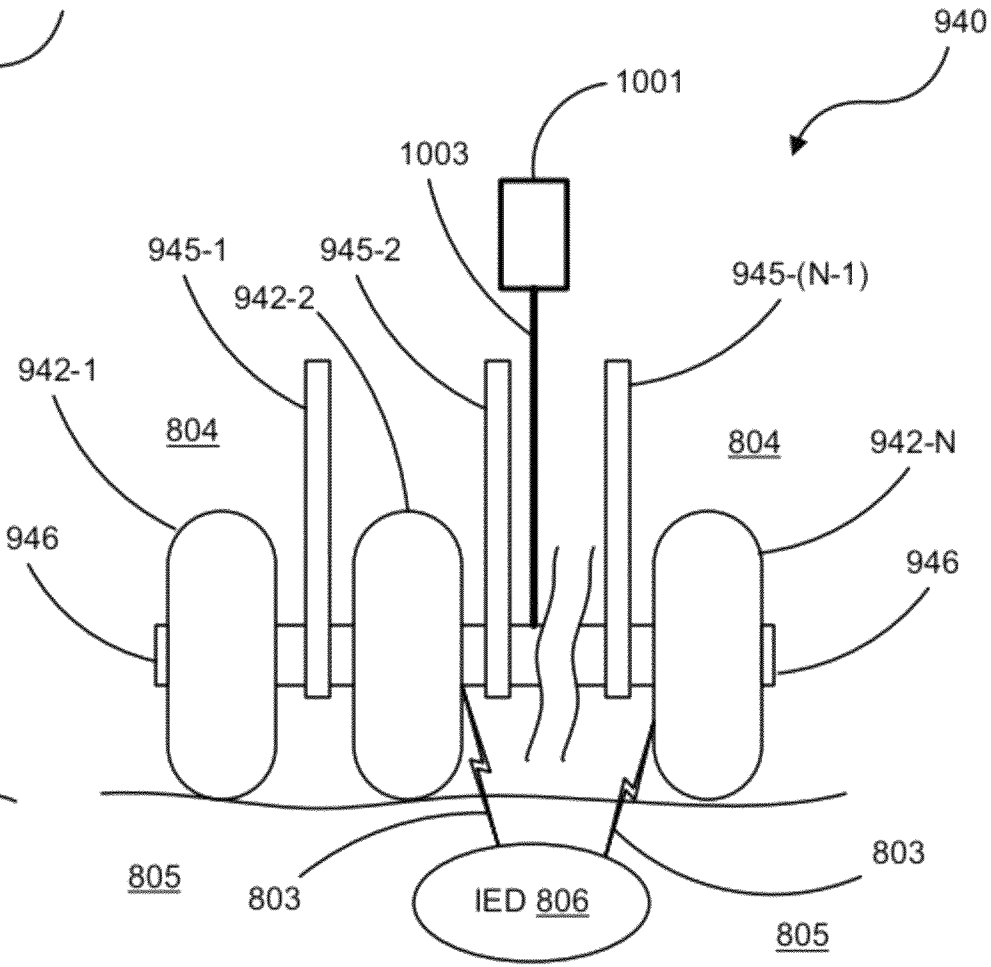
FIGS. 21 and 22 illustrate side and front views, respectively, of a mine roller system for pre-detonating an IED, landmine, or other explosive device, in one exemplary embodiment of the invention.
Figure 21:
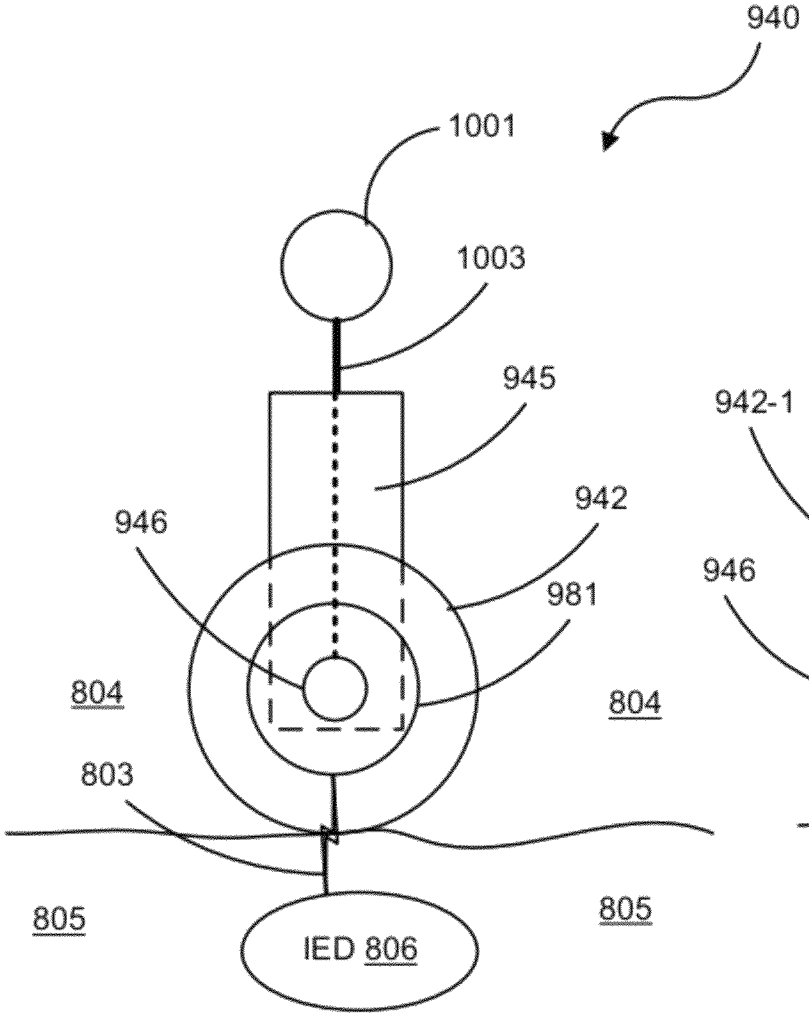

FIGS. 21 and 22 illustrate detailed side and front views, respectively, of a mine roller system 940, in one exemplary embodiment of the invention. In this embodiment, the mine roller system 940 is configured with an electrode 1001 that is operable to receive the electrical energy (e.g., from the power supply 801) and conduct the electrical energy to a conductive component of the mine roller system 940 that is likely to come into proximity with the IED 806. For example, the mine roller system 940 may be configured with a plurality of wheels 942-1-N that are movably mounted to the extender 941 with the mounts 945-1-(N-1) and the axle 946. The axle 946 may be electrically coupled to the electrode 1001 via the connection 1003 (e.g., a wire) such that the rims 981 of the wheels 942-1-N form an electric field capable of pre-detonating the IED 806 via the discharges 803. Such an embodiment may protect the vehicle 950 from inadvertent discharge thereto. For example, the mounts 945-1-(N-1) may be insulated and/or non conductive so as to prevent the wheels 942-1-N and/or the axel 946 from conducting thereto.

Figure 23:
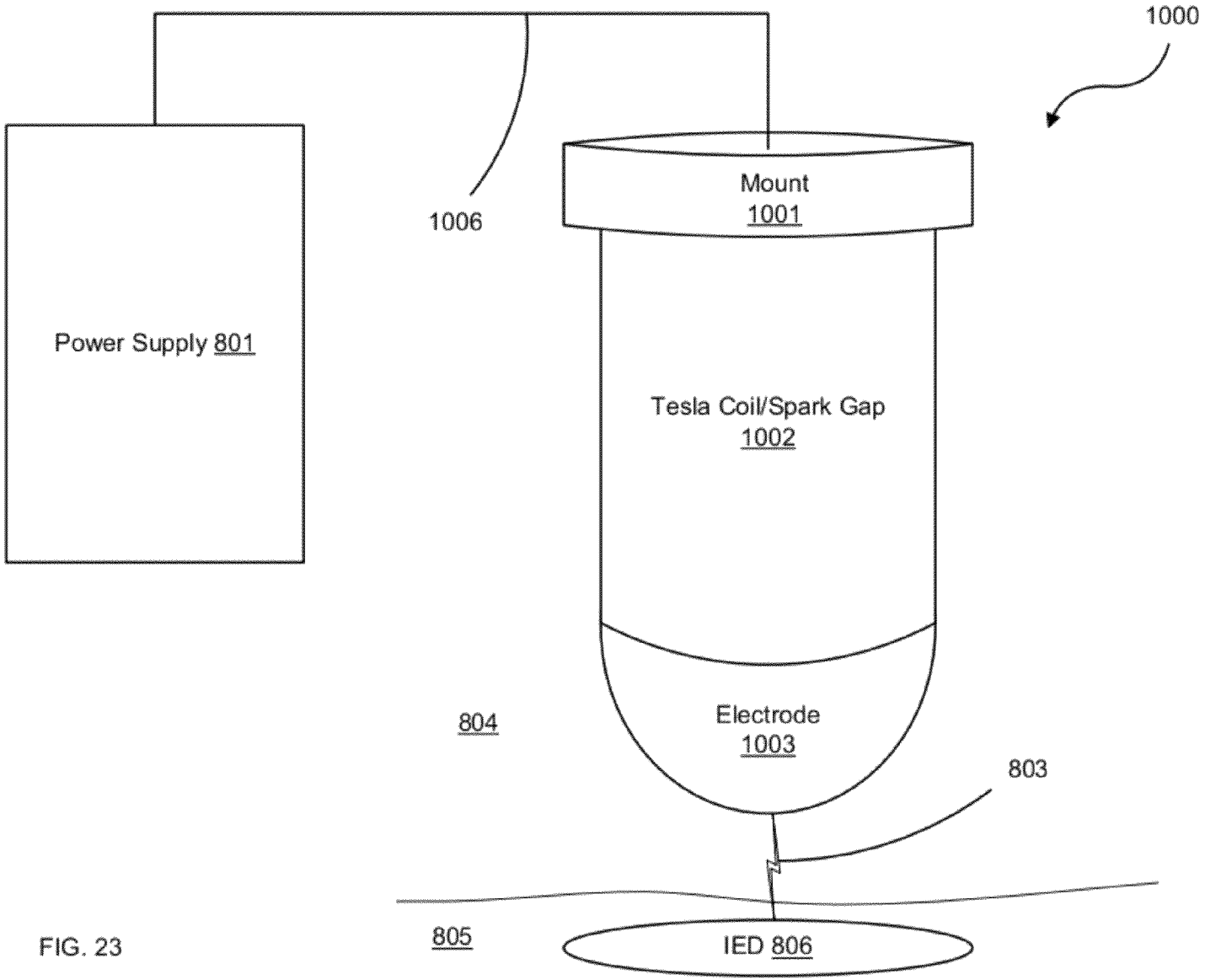
FIG. 23 illustrates an electrode system for pre-detonating an IED, landmine, or other explosive device, in one exemplary embodiment of the invention.

FIG. 23 illustrates an electrode system 1000 for pre-detonating an IED 806, landmine, or other explosive device, in one exemplary embodiment of the invention. In this embodiment, the electrode system 1000 is configured with a mount 1001 that is operable to retain the electrode system 1000 to some sort of extension means that provides the standoff position from the electrode 1003 and thus the IED 806. The mount 1001 is also operable to connect the electrode 1003 to the power supply 801 via a high-voltage power line 1006. The electrode system 1000 is configured with a Tesla coil/spark gap 1002 that is operable to increase the voltage from the power supply 801 and hold off the discharge 803 of the electrical energy from the power supply 801 through the electrode 1003. For example, the Tesla coil is operable to increase the voltage from the power supply 801. The Tesla coil may be configured with a capacitor on the output so as to store charge. The spark gap provides a controllable means for preventing electrical energy from discharging through the electrode 1003 until the charge on the output capacitor reaches a desired or predetermined level. Once the charge on the output capacitor reaches that desired level, the spark gap breaks down and conducts current to the electrode 1003 for discharge 803 to the IED 806.

The electrode 1003 as illustrated herein has a spherical shape that is operable to concentrate the electric field to a particular location on the electrode 1003. For example, the Tesla coil/spark gap 1002 provides a charge to the electrode 1003. The shape of the electrode 1003 maintains that charges as a relatively uniform electric field. Once the electrode 1003 comes within proximity of the IED 806, the electric field is enhanced on conductive elements of the IED 806. If the potential between that location and the IED 806 reaches a particular level to break down the air 804, the IED 806 discharges 803 to the electrode 1003 to pre-detonate the IED 806. That is, electric current flows through the discharge 803 and/or the arc 807 to pre-detonate the IED 806. This process enables the electrode 1003 to find the IED 806.

While the invention has been illustrated and described in detail in the drawings and foregoing description, such illustration and description is to be considered as exemplary and not restrictive in character. For example, certain embodiments described hereinabove may be combinable with other described embodiments. Accordingly, it should be understood that only the preferred embodiment and minor variants thereof have been shown and described and that all changes and modifications that come within the spirit of the invention are desired to be protected. Additionally, although the various embodiments disclosed above have been shown and described as being operable to pre-detonate various explosive devices, the invention is not intended to be limited to a guiding any particular explosive device in that the terms IED, landmine, roadside bomb, etc. may be used interchangeably to represent the concept of an explosive device.

What is claimed is:

1. A system for detonating an improvised explosive device (IED), including:

a power supply operable to pulse high voltage electrical energy; and an electrode having a shape operable to provide an electric field from the high voltage electrical energy that generates an electric arc to pre-detonate the IED, wherein the electrode includes a conductive wheel in contact with soil under which the IED is buried.

2. The system of claim 1, further including a spark gap configured between the power supply and the electrode and operable to increase the voltage of the electrical energy before delivery to the electrode.

3. The system of claim 1, wherein the electrode includes a chain in contact with soil under which the IED is buried.

4. The system of claim 3, wherein the chain is approximately half a foot in length to provide the electric arc through the soil to pre-detonate the IED.

5. The system of claim 1, wherein the shape of the electrode is operable to concentrate the electric field to a location on the electrode that finds the IED.

6. The system of claim 1, wherein a pulse of the high voltage electrical energy has a duration less than about 350 nanoseconds.

7. The system of claim 1, wherein a pulse of the high voltage electrical energy has a voltage of at least 50kV.

8. The system of claim 1, wherein a pulse of the high voltage electrical energy has a pulse repetition frequency less than about 500Hz.

9. The system of claim 1, wherein the electric arc is operable to propagate through soil from the electrode to the IED to pre-detonate the IED.

10. The system of claim 1, further comprising a mechanical extender that extends the electrode and includes a mine roller having conductive wheels that are operable to discharge the high voltage electrical energy to the explosive device.

11. The system of claim 1, wherein the high voltage power supply includes a Tesla coil.

12. The system of claim 1, wherein the high voltage power supply includes a spark gap.

13. The system of claim 1, wherein the high voltage power supply includes a magnetic compression power supply.

14. The system of claim 1, wherein the high voltage power supply includes a saturable reactor.

15. A system for detonating an improvised explosive device (IED), including:

a power supply operable to pulse high voltage electrical energy; and an electrode having a shape operable to provide an electric field from the high voltage electrical energy that generates an electric arc to pre-detonate the IED, further comprising a mechanical extender that extends the electrode and includes a mine roller having conductive wheels that are operable to apply compressive force to the explosive when rolling over the explosive.

16. The system of claim 15, further including a spark gap configured between the power supply and the electrode and operable to increase the voltage of the electrical energy before delivery to the electrode.

17. The system of claim 15, wherein the electrode includes a chain in contact with soil under which the IED is buried.

18. The system of claim 17, wherein the chain is approximately half a foot in length to provide the electric arc through the soil to pre-detonate the IED.

19. The system of claim 15, wherein the shape of the electrode is operable to concentrate the electric field to a location on the electrode that finds the IED.

20. The system of claim 15, wherein a pulse of the high voltage electrical energy has a duration less than about 350 nanoseconds.

21. The system of claim 15, wherein a pulse of the high voltage electrical energy has a voltage of at least 50kV.

22. The system of claim 15, wherein a pulse of the high voltage electrical energy has a pulse repetition frequency less than about 500Hz.

23. The system of claim 15, wherein the electric arc is operable to propagate through soil from the electrode to the IED to pre-detonate the IED.

24. The system of claim 15, wherein the conductive wheels are operable to discharge the high voltage electrical energy to the explosive device.

25. The system of claim 15, wherein the high voltage power supply includes a Tesla coil.

26. The system of claim 15, wherein the high voltage power supply includes a spark gap.

27. The system of claim 15, wherein the high voltage power supply includes a magnetic compression power supply.

28. The system of claim 15, wherein the high voltage power supply includes a saturable reactor.

* * * * *